US008398569B1

(12) United States Patent
Mortimer et al.

(10) Patent No.: US 8,398,569 B1
(45) Date of Patent: Mar. 19, 2013

(54) APPARATUS FOR GENERATING A VIBRATIONAL STIMULUS USING A ROTATING MASS MOTOR

(75) Inventors: Bruce J. P. Mortimer, Casselberry, FL (US); Gary A. Zets, Casselberry, FL (US)

(73) Assignee: Engineering Acoustics, Inc., Casselberry, FL (US)

( * ) Notice: Subject to any disclaimer, the term of this patent is extended or adjusted under 35 U.S.C. 154(b) by 1036 days.

(21) Appl. No.: 11/787,275

(22) Filed: Apr. 16, 2007

Related U.S. Application Data

(60) Provisional application No. 60/792,248, filed on Apr. 14, 2006.

(51) Int. Cl.
*A61H 1/00* (2006.01)

(52) U.S. Cl. ..... 601/46; 601/60; 601/82

(58) Field of Classification Search ..... 601/46, 601/48, 56, 58–60, 66, 67, 71, 72, 78, 82, 601/84, 49
See application file for complete search history.

(56) References Cited

U.S. PATENT DOCUMENTS

| | | | | | |
|---|---|---|---|---|---|
| 3,478,736 | A | * | 11/1969 | Roberts et al. | 601/71 |
| 4,076,320 | A | * | 2/1978 | Reiss | 406/32 |
| 4,513,737 | A | * | 4/1985 | Mabuchi | 601/101 |
| 4,535,760 | A | * | 8/1985 | Ikeda et al. | 601/57 |
| 4,675,907 | A | * | 6/1987 | Itagaki et al. | 381/152 |
| 5,140,979 | A | * | 8/1992 | Nakagawa | 601/108 |
| 5,300,095 | A | * | 4/1994 | Salazar | 601/21 |
| 5,327,886 | A | * | 7/1994 | Chiu | 607/96 |
| 5,424,592 | A | * | 6/1995 | Bluen et al. | 310/28 |
| 5,669,818 | A | * | 9/1997 | Thorner et al. | 463/30 |
| 5,676,637 | A | * | 10/1997 | Lee | 601/15 |
| 5,757,726 | A | * | 5/1998 | Tenghamn et al. | 367/152 |
| 5,904,660 | A | * | 5/1999 | Kim | 601/108 |
| 2003/0079559 | A1 | * | 5/2003 | Potts | 74/87 |

* cited by examiner

*Primary Examiner* — Kristen Matter
(74) *Attorney, Agent, or Firm* — Larry D. Johnson

(57) ABSTRACT

The present invention provides a novel implementation of a low cost eccentric mass motor vibrotactile transducer providing a point-like vibrational stimulus to the body of a user in response to an electrical input. Preferably the eccentric mass and motor form part of the transducer actuator moving mass. The actuator moving mass is constrained into vertical motion by a spring between the actuator housing and moving mass. The actuator moving mass is in contact with a skin (body) load. The actuator housing is in simultaneous contact with the body load. The body load, actuator moving mass, spring compliance and housing mass make up a moving mass resonant system. The spring compliance and system component masses can be chosen to maximize the actuator displacement and/or tailor the transducer response to a desired level. The mass of the motor/contactor assembly, mass and area of the housing, and the compliance of the spring are chosen so that the electromechanical resonance of the motional masses, when loaded by the typical mechanical impedance of the skin, are in a frequency band where the human body is most sensitive to vibrational stimuli 150-300 Hz. This configuration can be implemented as a low mass wearable vibrotactile transducer or as a transducer that is mounted within a soft material such as a seat. A particular advantage of this configuration is that the moving mass motion can be made almost independent of force loading on the transducer housing.

20 Claims, 7 Drawing Sheets

Tactor Performance for various rotational speeds

APPARATUS FOR GENERATING A VIBRATIONAL STIMULUS USING A ROTATING MASS MOTOR

CROSS REFERENCE TO RELATED APPLICATIONS

The present application claims the benefit of the filing date of U.S. Provisional Patent Application Ser. No. 60/792,248, filed 14 Apr. 2006.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to vibrators, transducers, and associated apparatus, and more specifically to an improved method and apparatus for generating a vibrational stimulus to the body of a user in response to an electrical input.

BACKGROUND INFORMATION AND DISCUSSION OF RELATED ART

The sense of feel is not typically used as a man-machine communication channel, however, it is as acute and in some instances as important as the senses of sight and sound, and can be intuitively interpreted. Tactile stimuli provide a silent and invisible, yet reliable and easily interpreted communication channel, using the human's sense of touch. Information can be transferred in various ways including force, pressure and frequency dependent mechanical stimulus. Broadly, this field is also known as haptics.

A single vibrotactile transducer can be used for a simple application such as an alert. Many human interface devices, for example a computer interface device, allow some form of haptic feedback to the user. A plurality of vibrotactile transducers can be used to provide more detailed information, such as spatial orientation of the person relative to some external reference. Using an intuitive body-referenced organization of vibrotactile stimuli, information can be communicated to a user. Such vibrotactile displays have been shown to reduce perceived workload by its ease in interpretation and intuitive nature (see for example: Rupert A H, 2000, Tactile Situation Awareness System: Proprioceptive Prostheses for Sensory Deficiencies. Aviation, Space, and Environmental Medicine, Vol. 71 (9):II, p. A92-A99).

The present invention relates to a low cost actuator assembly that conveys a strong, localized vibrotactile sensation (stimulus) to the body. These devices should be small, lightweight, efficient, electrically and mechanically safe and reliable in harsh environments, and drive circuitry should be compatible with standard communication protocols to allow simple interfacing with various avionics and other systems.

The study of mechanical and/or vibrational stimuli on the human skin has been ongoing for many years. Schumacher et al. U.S. Pat. No. 5,195,532 describes a diagnostic device for producing and monitoring mechanical stimulation against the skin using a moving mass contactor termed a "tappet" (plunger mechanical stimulator). A bearing and shaft is used to link and guide the tappet to the skin and means is provided for linear drive by an electromagnetic motor circuit, similar to that used in a moving-coil loudspeaker. The housing of the device is large and mounted to a rigid stand and support, and only the tappet makes contact with the skin.

The reaction force from the motion of the tappet is applied to a massive object such as the housing and the mounting arrangement. Although this device does have the potential to measure a human subject's reaction to vibratory stimulus on the skin, and control the velocity, displacement and extension of the tappet by measurement of acceleration, the device was developed for laboratory experiments and was not intended to provide information to a user by means of vibrational stimuli nor be implemented as a wearable device.

Various other types of vibrotactile transducers, suitable for providing a tactile stimulus to the body of a user, have been produced in the past. Prior vibrotactile transducers designs have incorporated electromagnetic devices based on a voice coil (loudspeaker or shaker) design, an electrical solenoid design, or a simple variable reluctance design. The most common approach is the use of a small motor with an eccentric mass rotating on the shaft, such as is used in pagers and cellular phones. A common shortcoming of these previous design approaches is that the transducers are rapidly damped when operated against the body—this is usually due to the mass loading of the skin or the transducer mounting arrangement (for example the foam material that would surround a vibrotactile transducer if it were mounted in a seat).

Pager motors, or eccentric mass EM motors, are usually constructed with a DC motor with an eccentric mass load such as half-circular cylinder that is mounted onto the motor's shaft. The motor is designed to rotate the shaft and its off-center (eccentric) mass load at various speeds. From the conservation of angular momentum, the eccentric mass imparts momentum to the motor shaft and consequently the motor housing. The angular momentum imparted to the motor housing will depend on the mounting of the motor housing, the total mass of the motor, the mass of the eccentric rotating mass, the radius of the center of mass from the shaft and the rotational velocity. In steady state, the angular momentum imparted to the housing will result in three dimensional motion and a complex orbit that will depend on the length of the motor, the mounting geometry, the length of the shaft and center of gravity of the moving masses (see for example J. L. Meriam, Engineering Mechanics: Dynamics, SI Version, 5th Edition, 2003, Wiley). This implementation applies forces in a continually changing direction confined to a plane of rotation of the mass. Thus the resultant motion of the motor housing is three dimensional and complex. If this motion is translated to an adjacent body, we may interpret the complex vibration (and perceived vibrational stimulus) to be diffuse and a "wobble" sensation.

The rpm of the EM motor defines the tactile frequency stimulus and is typically in the range of 60-150 Hz. Typically these devices are intended to operate at a single (relatively low) frequency, and cannot be optimized for operating over the frequency range where the skin of the human body is most sensitive to vibrational stimuli (see for example Verrillo R. T. (1992) "Vibration Sensation in Humans", Music Perception, Vol 9, No 3, pp 281-302). It may be possible to increase the vibrational frequency on some EM motors by increasing the speed of the motor (for example by increasing the applied voltage to a DC motor). However, there are practical limits to this as the force imparted to the bearing increases with rotational velocity and the motor windings are designed to support a maximum current. It should also be apparent that the angular momentum and therefore the eccentric motor vibrational output also increases with rotational velocity which limits use of the device over bandwidth.

The temporal resolution of EM motors is limited by the start up (spin-up) times which can be relatively long, on the order of 100 ms or so. This is somewhat longer than the skin's temporal resolution, thus can limit data rates. If the vibrotactile feedback is combined with other sensory feedback such as visual or audio, the start-up delay has the potential of introducing disorientation. The slow response time needed to achieve a desired rotational velocity is due the acceleration and deceleration of the spinning mass—some motor control methods can address this by increasing the initial torque on turn on. It should be evident that motors with smaller eccentric masses may be easier to drive (and reduce spin-up time) however, thus far a reduced eccentric mass also results in an actuator that produces a lower vibrational amplitude.

There are two important effects associated with the practical operation of EM motors as vibrotacile transducers. Firstly the motion that is translated to an adjacent body will depend on the loading on the motor housing—from the conservation of momentum, the greater the mass loading on the motor (or transducer housing) the lower the vibrational velocity and perceived amplitude stimulus. Secondly, from the conservation of momentum, if the mass loading on the motor is changed, the torque on the motor and angular rotation rate will also change. In fact it is not possible to simultaneously and independently control output vibration level and frequency. This is obviously undesirable from a control standpoint, and in the limiting case, a highly loaded transducer would produce minimal displacement output and thus be ineffective as a tactile stimulus. In fact there have been several reports of inconsistency in results (Robert W. Lindeman, John L. Sibert, Corinna E. Lathan, Jack M. Vice, The Design and Deployment of a Wearable Vibrotactile Feedback System, Proceedings of the Eighth International Symposium on Wearable Computers (ISWC'04)) and modeling attempts to overcome this using complex mounting (Haruo Noma et al. A Study of Mounting Methods for Tactors Using an Elastic Polymer, Symposium on Haptic Interfaces for Virual Environment and Teleoperator Systems 2006). Thus depending on the mounting configuration, the displacement into skin and perception of vibrational stimulus is variable in frequency and level. This is obviously undesirable from a control standpoint, and in the limit, a highly loaded transducer would also produce minimal displacement output and thus be ineffective as a tactile stimulus.

Shahoian U.S. Pat. No. 6,697,043 B1 describes a computer mouse haptic interface and transducer that uses a motor transducer. This patent teaches the use a mechanical flexure system to convert rotary force from the motor to allow a portion of the housing flexure to be linearly moved. This approach relies on a complex mechanical linkage that is both expensive to implement and at high rotational velocities prone to deleterious effects of friction. It is therefore only suited to very low frequency haptic feedback.

In prior art, Shahoian U.S. Pat. No. 6,680,729 B1 an EM motor that is connected to the housing via a compliant spring. The system makes up a two degree of freedom resonant mechanical system. The motor mass and spring systems are completely contained within a rigid housing. The movement of the motor mass in this case acts to impart an inertial force to the housing. This type of transducer configuration is known as a "shaker". The design claims improved efficiency and the ability to be driven by a harmonic motor drive for use as a haptic force feedback computer interface. The invention does not address any loading on the housing and in fact assumes that there are no other masses or mechanical impedances acting on the exterior of the housing.

Linear "shaker" transducers are well known in prior art, for example Clamme in U.S. Pat. No. 5,973,422 describes a low frequency vibrator with a reciprocating piston mass within a low friction bearing, actuated by an electromagnetic with a magnetic spring, having a spring constant K. The ratio of K to the mass M of the reciprocating member is made to be resonant in the operating frequency range of the vibrator. Other examples of prior art "shaker" transducer designs include U.S. Pat. Nos. 3,178,512, 3,582,875 and 4,675,907.

In summary, EM motors when used as vibrotactile transducers, provide a mounting dependent vibration stimulus and a diffuse type sensation, so that the exact location of the stimulus on the body may be difficult to discern; as such, they might be adequate to provide a simple alert such as to indicate an incoming call on a cellular phone, but would not be adequate to reliably provide spatial information by means of the user detecting stimuli from various sites on the body. The prior art fails to recognize the design requirements to achieve a small, wearable vibrotactile device that provides strong, efficient vibration performance (displacement, frequency, force) when mounted against the skin load of a human. This is particularly true when considering the requirement to be effective as a lightweight, wearable tactile display (e.g., multiple vibrotactile devices arranged on the body) in a high noise/vibration environment as may be found, for example, in a military helicopter. Further, the effect of damping on the transducer vibratory output due to the additional mechanical impedance coupled to the mounting has not been adequately addressed. The prior art further fails to effectively utilize an eccentric mass motor as the force generator in vibrotactile transducers or provide methods that extend the high frequency bandwidth and control the response of the transducer.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention provides a novel implementation of a low cost eccentric mass motor vibrotactile transducer. Preferably the eccentric mass and motor form part of the transducer actuator moving mass (mechanical contactor). The actuator moving mass is in contact with a skin (body) load. The actuator moving mass is constrained into approximately vertical motion by a spring between the actuator housing and moving mass. The rotational forces provided by an eccentric mass (EM) motor are therefore constrained into predominantly one dimensional motion that actuates perpendicularly against a skin load. The actuator housing contacting face is in simultaneous contact with the body load (skin). The body load, actuator moving mass, spring compliance and housing mass make up a moving mass resonant system. The spring compliance and system component masses can be chosen to maximize the actuator displacement while minimizing the housing motion, and tailor the transducer response to a desired level. This configuration can be implemented as a low mass wearable vibrotactile transducer or as a transducer that is mounted within a soft material such as a seat. A particular advantage of this configuration is that the moving mass motion can be made almost independent of force loading on the transducer housing.

The method and apparatus for generating a vibrational stimulus of this invention provides an improved small, low cost vibrotactile transducer to provide a strong tactile stimulus that can be easily felt and localized by a user involved in various activities, for example flying an aircraft, playing a video game, or performing an industrial work task. Due to the high amplitude and point-like sensation of the vibrational output, the inventive vibrotactile transducer ("tactor") can be felt and localized at various positions on the body, and can provide information to the user. The transducer itself is a small package that can easily be located against the body when installed under or on a garment, or on the seat or back of a chair. The drive electronics are compact, able to be driven by batteries, and follows conventional motor driver control techniques. The overall transducer may include interface circuitry that is compatible with digital (e.g., TTL, CMOS, or similar) drive signals typical of those from external interfaces available from computers, video game consoles, and the like.

A number of actuator drive parameters can be varied. These include vibrational amplitude, drive frequency, modulation frequency, and wave-shape. In addition single or groups of transducers can be held against the skin, in various spatial configurations round the body, and activated singly or in groups to convey specific sensations to the user.

It is therefore an object of the present invention to provide a new and improved method and apparatus for generating a vibrational stimulus to the body of a user.

It is another object of the present invention to provide a new and improved low cost vibrotactile transducer and associated drive controller electronics.

A further object or feature of the present invention is a new and improved transducer that can easily be located against the body when installed under or on a garment, or on the seat or back of a chair.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted. Further the following description may describe any combination of spring and/or bearing as a suspension mechanism.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
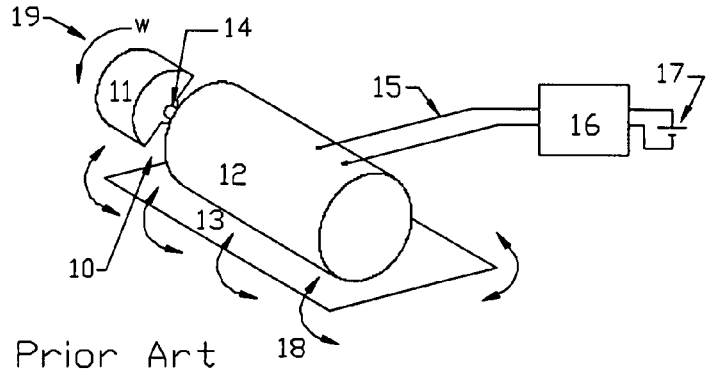
FIG. 1 is a perspective view of a prior art eccentric mass or pager motor transducer and associated controller and driver electronics.

Referring to FIGS. 1 through 13, wherein like reference numerals refer to like components in the various views, there is illustrated therein a new and improved vibrotactile transducer apparatus, generally denominated 20 herein.

FIG. 1 illustrates the operation of prior art eccentric mass (EM) motor or pager motors 10. An eccentric mass 11 is mounted on a shaft 14 driven by a motor 12 that is mounted on a base 13. The motor is usually a DC motor although various synchronous, stepper, variable reluctance, ultrasonic and AC motors can be used. The motor 12 is connected to a controller unit 16 by wires 15. The controller unit is powered with a battery or power supply 17. The eccentric mass 11 is usually half-circular cylinder or similar shape where the center of mass is not the same as the center of rotation. The center of rotation is determined by the motor's shaft 14. The motor is designed to rotate the shaft 14 and off-center mass load 11 at various rotational velocities 19. From the conservation of angular momentum, the eccentric mass 11 imparts momentum to the motor shaft 14 and consequently the motor housing and base 13. The angular momentum imparted to the motor housing will depend on geometry of the motor 12 and base 13, the total mass of the motor 12, the mass of the eccentric rotating mass 11, the radius of the center of mass from the shaft 14, the length of the shaft 14 and the rotational velocity 19. In steady state, the angular momentum imparted to the housing will result in an eccentric orbit. This implementation applies forces in a continually changing direction confined to a plane of rotation of the mass, providing a "wobble" or rocking vibration 18.

Figure 2:
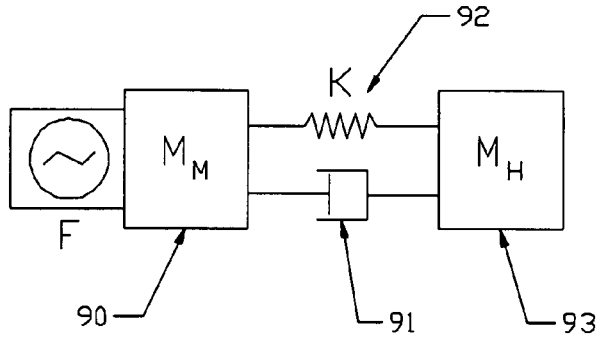
FIG. 2 is a "free-body diagram" of prior art configuration directed to increasing the transmissibility of inertial forces produced by an inertial actuator (EM motor and spring) on the housing of a tactile feedback device.

FIG. 2 shows a "free-body diagram" of prior art configuration directed to increasing the transmissibility of inertial forces produced by an inertial actuator. The EM motor 90 acts on a compliant spring 92 and damping element 91 with a reaction mass from the housing 93. The spring and mass of the motor are chosen to be resonant in a band where inertial forces are desired to be maximum. This configuration is known as a shaker as the inertial mass oscillates internal to the housing. The force imparted to the housing will depend on the mass of the housing compared to the EM motor mass. In fact the housing mass is usually large to reduce the additional loading and reduction in force that would accompany practical mounting of the transducer and/or the mechanical impedance associated with a skin load. A severe shortcoming of the prior art is in extending such designs to wearable transducer systems where the overall mass of the complete transducer (and housing) should be kept as low as possible. Further, mounting such prior-art transducer designs for example, within the viscous foam material found in seats and related padding or even against the skin of a body, results in the mounting loading the complete transducer housing surface with mechanical damping. Such damping will decrease the force and vibrational output to low levels and severely limit the efficiency of prior art transducer designs.

Figure 3:
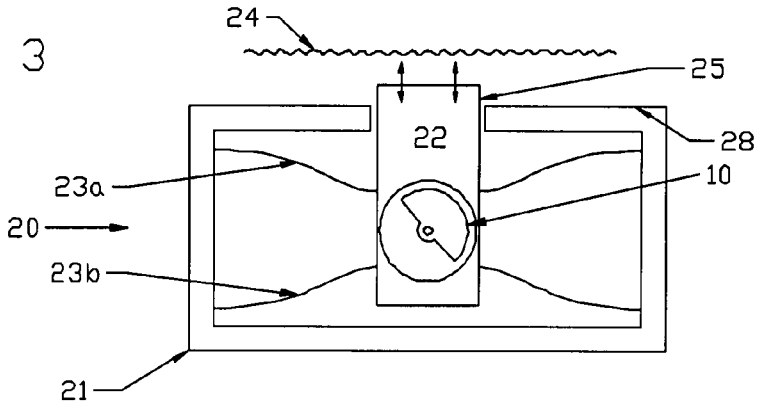
FIG. 3 is a side elevation cross-sectional view of a vibrotactile transducer of this invention.

FIG. 3 shows the first preferred embodiment of the vibrotactile transducer of this invention. The object of this invention is to provide a potentially lightweight, physically compact, low cost and electrically efficient tactile transducer is herein described, that could elicit a localized sensation on the skin. The vibrational output can also be designed to be independent of the loading effects of the intended housing or load. The vibrational output is further designed to preferably actuate the moving contactor 22 perpendicular to the skin load 24. FIG. 3 is a cross sectional schematic view of an eccentric mass pager motor transducer 20. The associated controller and driver electronics 16 is not shown. However it should be apparent that varying the signal and/or number of tactors acted on using an appropriate choice of signal characteristics and/or modulation, different information can be provided to a user in an intuitive, body referenced manner.

FIG. 3 shows a side elevation cross-sectional view of a vibrotactile transducer 20. Transducer 20 produces a vibrational stimulus to the body of the user 24 in response to an electrical input. The device 20 includes a mechanical contactor 22 protruding through an opening 25 in the front contacting face 28 of the housing 21.

An eccentric mass motor or pager motor 10 is used as the force actuator in the transducer. The motor 10 is mounted on the contactor 22. The contactor 22 is a moving element and actuates upon the body of the user 24 (usually a skin load). The motor 10 may be preferentially mounted within an opening in a contactor 22. The contactor 22 is coupled to the vibrotactile transducer housing walls 21 via a set of compliant springs 23*a* and 23*b*. The spring 23 compliance are specially chosen, usually to be resonant with the mass elements in the system (including the mechanical impedance elements contributed by the body load 24). The spring 23 elements are also chosen to have characteristics that constrain the motion of the contactor 22 to predominantly vertical displacement i.e. the lateral compliance is much lower than the vertical spring compliance. These characteristics can, for example, be achieved by a pair of disc shaped planar springs described hereinafter.

Preferably the front contacting face of the housing 28 and the mechanical contactor 22 are held in simultaneous contact with the user's body (skin) 24. The mechanical contactor 22 is designed to be the predominant moving mass in the system, conducting vibratory motion perpendicular to the skin and consequently applying a vibrotactile stimulus into a skin load. The housing 21 and housing contacting face 28 are allowed to vibrate at a reduced level and substantially out of phase with the mechanical contactor as described hereinafter. To account for the elasticity of the skin 24 and/or the layers of clothing between the tactor and the skin, the contactor 22, in its rest position, is raised slightly above the front surface 28 of the housing 38. The height of the contactor 22 relative to the housing contacting surface 28, and the compliance of the springs are chosen so that when the housing and contactor is pressed against the skin of the user, the contactor and EM motor 10 assembly are displaced with respect to the housing to simultaneously pre-load the contactor against the skin and the contactor/EM motor assembly against the action of the spring. Preferably the height of the contactor 22 relative to the front surface 28 should be about 1 mm for appropriate bias preload into the skin or typical skin combined with intermediate layers of clothing or covering material.

Figure 4:
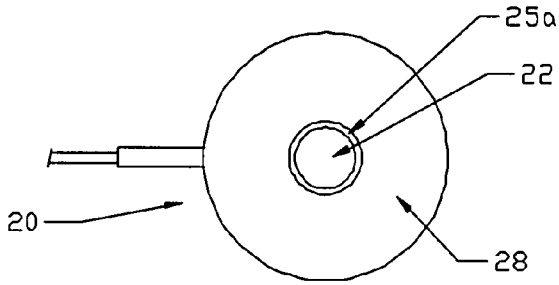
FIG. 4 is a plan view of a vibrotactile transducer of this invention, illustrating the contactor, a radial gap surrounding the contactor, and the housing/surround plate.

FIG. 4 is a plan view of a vibrotactile transducer 20 illustrating particular features of this invention. The housing contacting face 28 and the mechanical contactor 22 are in simultaneous contact with the skin load. A radial gap 25*a* results between the opening in the tactor housing 28 and the protruding moving mechanical contactor 22. In this configuration, the face 28 of the tactor housing in contact with the skin can act as a "passive surround" that mechanically blocks the formation of surface waves that otherwise would radiate from the mechanical contactor 22 on the surface of the skin when the mechanical contactor oscillated perpendicularly against the skin. This is beneficial in restricting the area elicited to an area closely approximated by the area size of the face of the mechanical contactor 22, and therefore meeting the object of creating a localized, point like vibrotactile sensation. The approximately 0.030 inch radial gap 25*a* between the mechanical contactor 22 and the surround 28 provides a sharp delineation between vibrating and minimally-vibrating skin surfaces, a feature that improves tactile sensation and localization.

In designing a practical wearable vibrotactile device 20, the overall mass of the transducer must be small, preferably less than 50 g. This requirement includes the mass of the mechanical contactor, motor components and housing. The housing should be robust and should facilitate mounting onto a belt, seat, clothes and the like.

Figure 5:
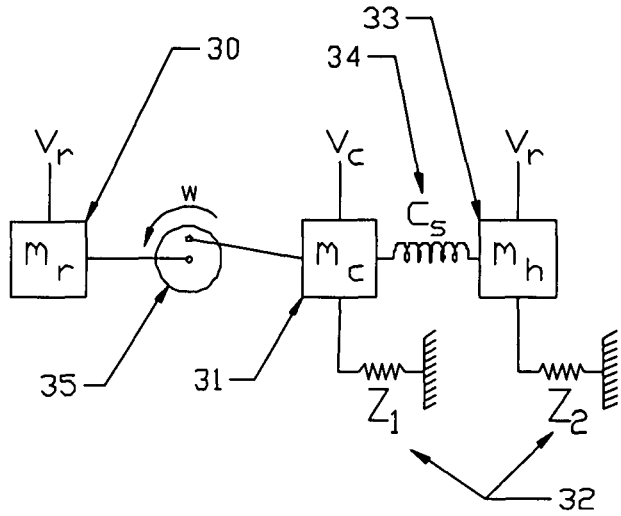
FIG. 5 is a "free-body diagram" description of a transduction model for the eccentric mass motor vibrotactile device.
Figure 6:
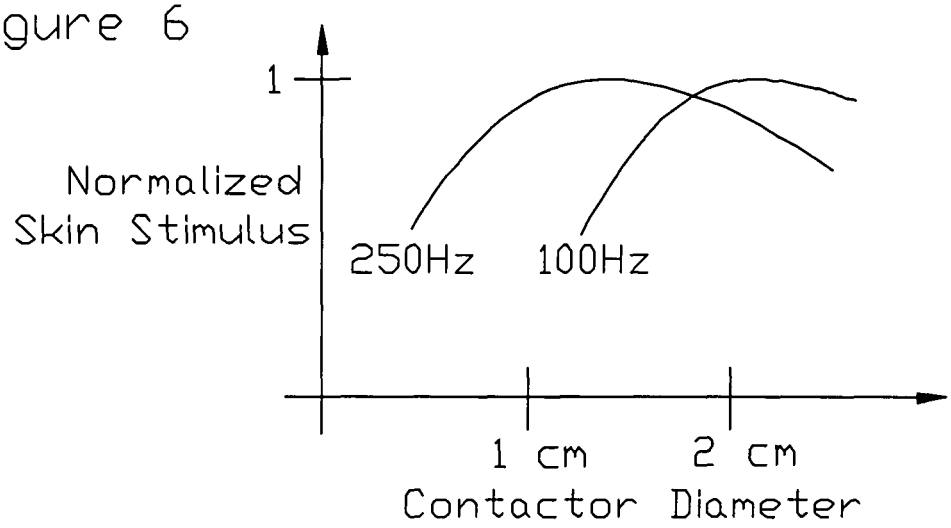
FIG. 6 is a plot of "skin stimulus" against various diameters of contactor for various frequencies.

A description of a transduction model for the dual moving mass vibrotactile device 20 is shown in the "free-body diagram" of FIG. 5. This is complete model for the vibrotactile transducer of this invention. The system includes components well known in mass-spring, force actuator systems where the ratio of the moving mass $M_c$, and the spring constant $K_t$ are used to determine the square of the resonance frequency (for the actuator operating in the absence of loading such as the contactor moving freely in air). The loading effect of the skin against the mechanical contactor 22 and housing 28 and the mechanical parameters such as mass and area are included in the "free-body diagram" model.

The motor in the vibrotactile device 35 rotates at ω rad/s and acts on the eccentric load mass $M_r$ 30 and produces a reaction force into the mechanical contactor mass $M_c$ 31. This EM motor is the actuator or force driver for the system. The mechanical contactor mass 31 is the total moving mass including the mass of the motor housing, mechanical contactor and assembly. The eccentric load mass 30 is unconstrained in the system and is free to rotate. The mechanical contactor mass 31 acts upon the skin or body load through lumped mechanical impedance $Z_1$ and the housing mass 33 via a spring compliance $C_s$ 34. The housing mass 33 also acts on a skin or body lumped mechanical impedance load represented by $Z_2$. Numerical values for the skin impedance components can be found in E. K. Franke, Mechanical Impedance Measurements of the Human Body Surface, Air Force Technical Report No. 6469, Wright-Patterson Air Force Base, Dayton, OH, and T. J. Moore, et al, Measurement of Specific Mechanical Impedance of the Skin, J. Acoust. Soc. Am., Vol. 52, No. 2 (Part 2), 1972. These references show that skin tissue has the mechanical input impedance of a fluid-like inertial mass, a spring-like restoring force and a viscous frictional resistance. The numerical magnitude of each component in the skin impedance depends on the area of the mechanical contactor or housing contacting face and, as can be expected, the resistive loading of the skin is shown to increase with increasing mechanical contactor (or housing contacting face) diameter.

In FIG. 5 the velocity of the housing is represented by Vh, the mechanical contactor velocity is Vc. The mechanical contactor mass 31 contains the motor Mh. The total suspension spring 23*a* and 23*b* is represented in the mechanical compliance Cs. The system of masses and mechanical interconnections makes up a resonant system. The masses 30, 31 and 33 can be chosen together with the compliance 34 and loading $Z_1$ and $Z_2$ to achieve resonance at a selected frequency. This frequency may be the operating frequency for maximum contactor displacement, or some other selected frequency to shape the overall transducer vibration response over a wider bandwidth (as described hereinafter). It is desirable to maximize the mechanical contactor velocity is Vc whilst simultaneously minimizing the velocity of the housing Vh.

The equations of motion for this mechanical circuit can be solved using well known electro-acoustic analogous circuit design techniques. A skin-like load impedance is assumed to be acting on both the housing Zh, and the contactor Zc ($Z_2$ and $Z_1$ respectively) Thus complex mechanical properties of the skin, complete mechanical vibrotactile system components and motional parameters are described with this set of equations. Analysis of this system of equations is usually by direct mathematical analysis or using a computer-based equation solver. The results of such a simulation are shown in figures hereinafter.

The sensitivity of the bodies skin receptors to vibrational displacement is well known (see for example Bolanowski, S., Gescheider, G., Verrillo, R., and Checkosky, C. (1988). "*Four channels mediate the mechanical aspects of touch", J. Acoust. Soc. Am.,* 84(5), 1680-1694, and; Bolanowski, S., Gescheider, G., and Verrillo, R. (1994). "*Hairy skin: psychophysical channels and their physiological substrates", Somatosensory and Motor Research,* 11 (3), 279-290.). Three receptor systems thought to contribute to detection of vibrotactile stimuli at threshold under normal conditions—Pacinian corpuscles (Pc), Meissner's corpuscles, and Merkel's disks. Of these, the Pacinian corpuscles are the most sensitive. At 250 Hz, the sensitivity of the human skin to displacement is less than 1 μm (Pc).

Mechanotransduction is the process by which displacement is converted into action potentials. Pc receptors are located relatively deeply within the skin structure. In this range, the human perception of vibration depends primarily on mechanical contactor displacement, and is most sensitive to displacement that is normal to the skin surface (as opposed to tangential or shear). Pc receptors also show an effect known as special summation where there is a reduction in detection threshold as a function of the contact area. Such a mechanism has been explained as the addition of energy from larger and larger areas of stimulation.

If we define the "skin stimulus" to be the product of the mechanical contactor area and the relative mechanical contactor displacement, we can solve the equations of motion for the system at 250 Hz and 100 Hz and plot "skin stimulus" against various diameters of contactor in cm (keeping the other parameters constant). This function, shown in FIG. 6 clearly describes a range of contactor diameters that will produce an optimum stimulus. Preferably the optimum vibrotactile contactor diameter into skin load should have a diameter of about 1 cm at 250 Hz and 2 cm at 100 Hz.

Figure 7:
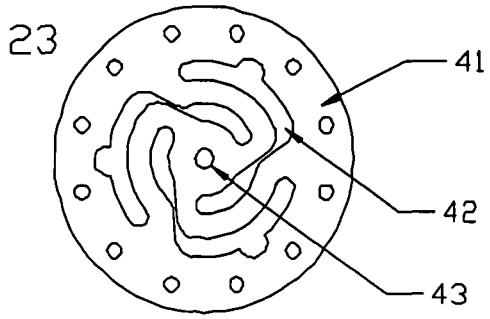
FIG. 7 is a plan view of a planar spring that may be used in the transducer apparatus.

FIG. 7 is a plan view of a planar spring 23 that may be used in the transducer apparatus. Design of the circular planar spring 23 exhibits low compliance (high stiffness) in a plane parallel to the spring, and a high compliance (low stiffness) in a plane perpendicular to the spring. The spring consists of a flat sheet 41 manufactured with spacing 42 and a center hole 43.

The springs 23 serve as a suspension mechanism to position the motor and mechanical contactor assembly concentric to the housing assembly, and provide a controlled mechanical compliance in the perpendicular direction (direction of motion) so that when the mechanical contactor and housing is pressed against the skin of the user, the mechanical contactor is displaced with respect to the housing to simultaneously pre-load the mechanical contactor against the skin and the contactor/motor assembly against the action of the spring. The compliance of the spring in the perpendicular direction also serves to set the mechanical resonance frequency of the transducer when applied to the skin, as described previously. The circular planar spring also serves to constrain the displacement of the mechanical contactor (including the EM motor) to the perpendicular direction.

Figure 8:
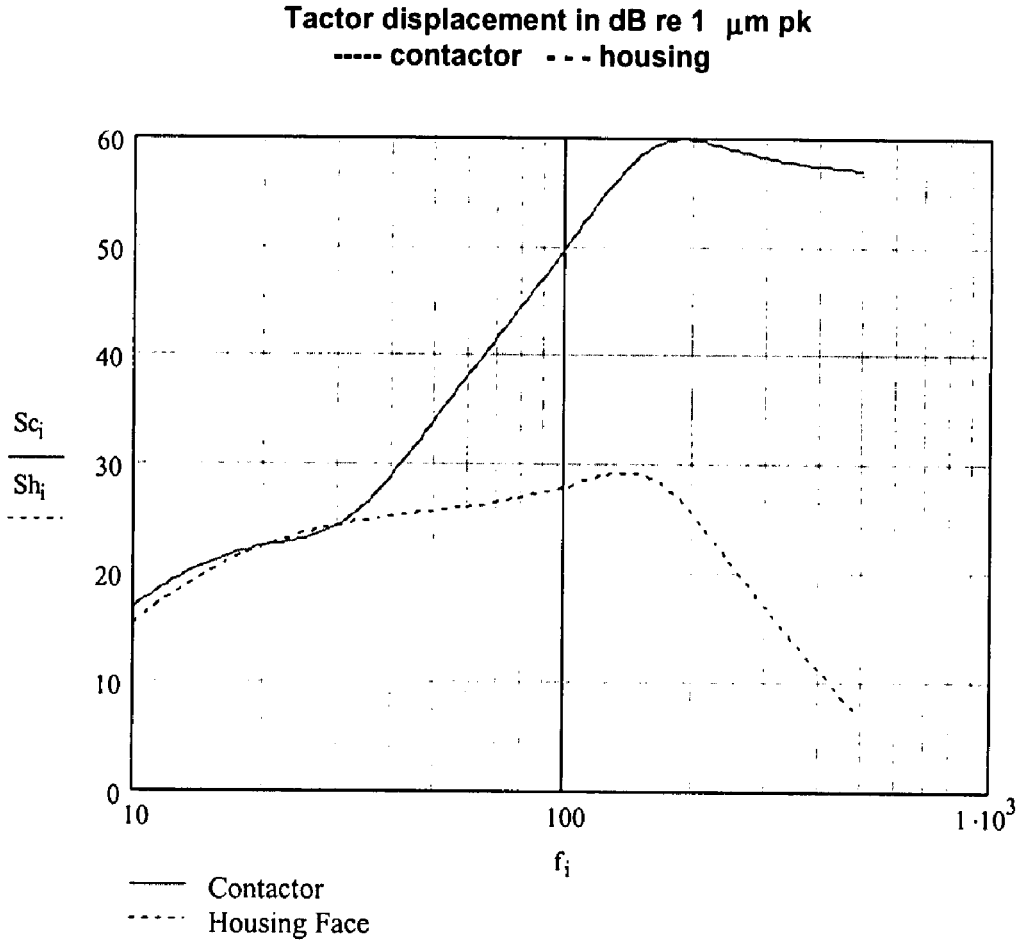
FIG. 8 is a typical plot of the performance of the vibrotactile transducer of this invention.
Figure 9:
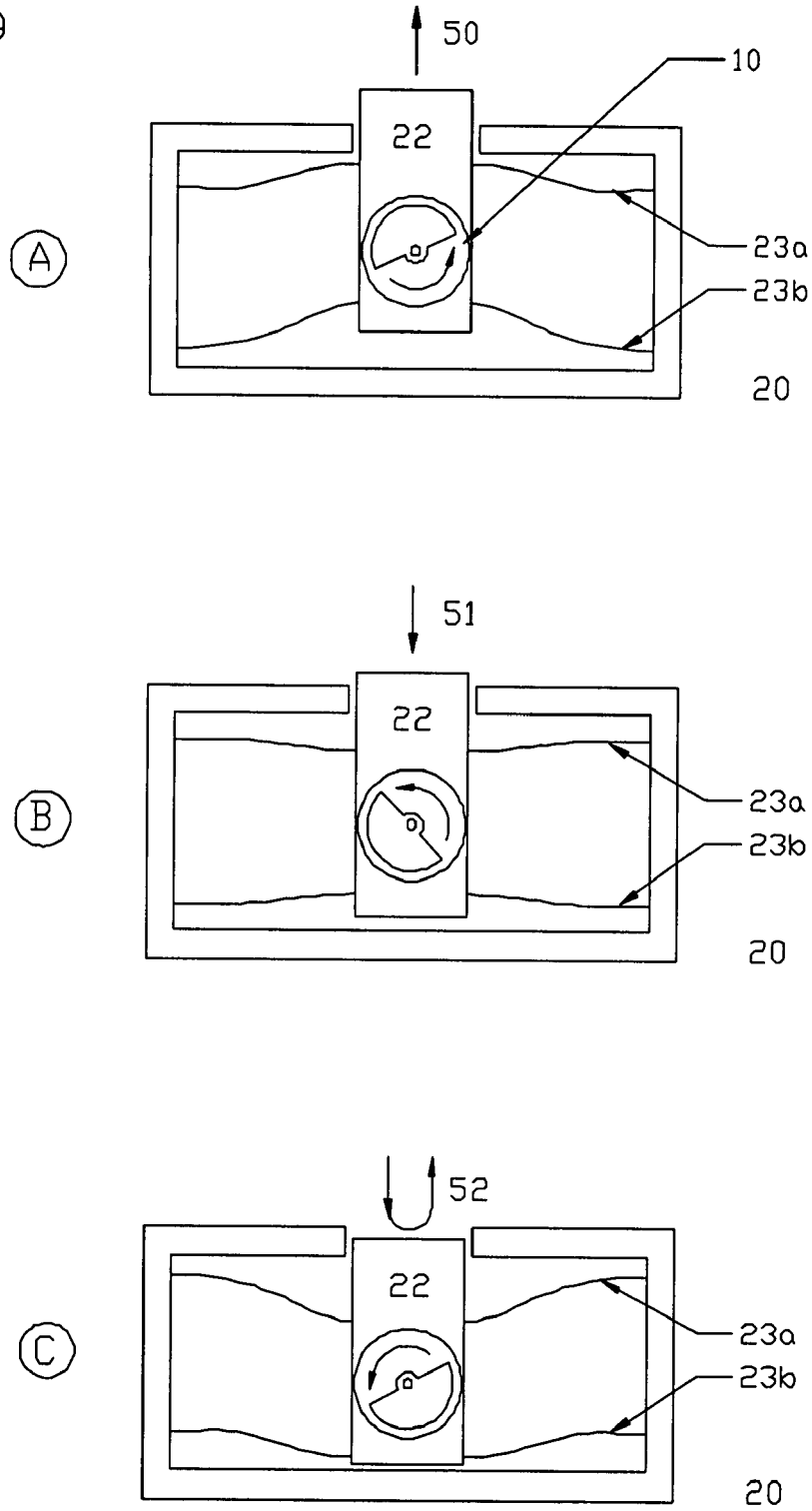
FIGS. 9A-9C are a series of side elevation cross-sectional views of the transducer of FIG. 3 illustrating the magnet assembly and contactor in various stages of reciprocating motion.

FIG. 8 shows the computer simulated results of solving the equations of motion for the mechanical system described previously in FIG. 3 and FIG. 5. The housing mass was chosen to be 25 grams, the mechanical contactor mass (including a EM motor) is 3.5 grams and the diameter of the mechanical contactor is 1 cm and the housing front face 2.5 cm. The EM motor is swept through a range of angular frequencies and the relative housing and contactor velocities and displacement are calculated for the condition of a skin (mechanical impedance) loading the housing and the contactor. The compliance of the springs for this specific example was chosen to be 6.6 $10^{-4}$ N/m. The output response shows high vibrational mechanical contactor displacement in the range 100-300 Hz. Note that a particular feature of this invention is to limit the vibrational displacement of the housing surface as is shown in FIG. 8. The transducer output vibratory characteristics can be designed by varying the characteristics of the EM motor and the mechanical elements (contactor mass and area, housing mass and area, spring compliance). Usually the characteristics of the EM motor are determined in advance (with size, cost and motor performance as the selection criterion). The contactor diameter is chosen using FIG. 7 (which in turn requires knowledge of the desired operating frequency range for the actuator and the mechanical loading (usually the skin). The housing area, mass and spring compliance are chosen by solving or simulating the resultant equations of motion for the complete transducer over a range of frequencies. The output (contactor) vibratory displacement can be maximized (by iteration and parameterization of the variables) within a frequency range, preferably within 50 to 300 Hz. Additional damping may also be optionally added to the system through the use of dissipative materials (for example foams) that are added to the spring mechanical element and contactor within the transducer.

FIGS. 9A-9C are a series of side elevation cross-sectional views of the transducer 20 of FIG. 3 illustrating the assembly and mechanical contactor in various stages of reciprocating motion. The eccentric mass (EM) motor or pager motor 10 is connected to an external power source and controller electronics (not shown) which causes the motor shaft and eccentric mass load to rotate. From the conservation of angular momentum, and the centering action of the spring elements 23*a* and 23*b*, the mechanical contactor 22 moves about the neutral 51 position (FIG. 9B). On the positive half cycle 50 as determined by the forcing function of the EM motor rotation (FIG. 9A), the eccentric mass motor 10 rotates the such that the reaction force on the mechanical contactor 22 moves forward depressing the mechanical contactor 22 from its neutral position further into the skin (the skin load is not shown in this diagram). On the negative half-cycle (FIG. 9C), the mechanical contactor 22 pulls away from the skin until it reaches its fully retracted state 52. During these cycles the housing, acting as the reaction mass, moves in the opposite direction to the contactor, with reduced amplitude.

The drive signal depends on the motor 10 design, but is typically a DC voltage. A particular problem with DC motors is the start up characteristics and consequently slow rise time. This can be reduced in part using pre-compensated drive voltage waveforms—increasing the voltage and motor torque at start up. An alternative approach is to keep the motor 10 rotating at slow angular velocity at periods when the vibrotactor transducer system 20 is intended to be off. This has the effect of avoiding motor startup delays and the effects of stiction in the mechanical system. Operating the vibrotactile transducer at low frequencies can be designed to cause a vibrational stimulus to be applied to a person's body which is below the threshold for detection. For example, FIG. 8 shows a very low transducer vibrational output at below 20 Hz. It would be preferable to maintain the rotation of the EM motor and the transducer actuator output at below 20 Hz in periods where the transducer is to be "off". The EM motor can be rapidly (minimal rise-time) accelerated to a higher frequency for transducer actuation conditions. This configuration therefore avoids the well known start-up delays associated with motors and also the high starting torque requirements required for DC motors.

Figure 10:
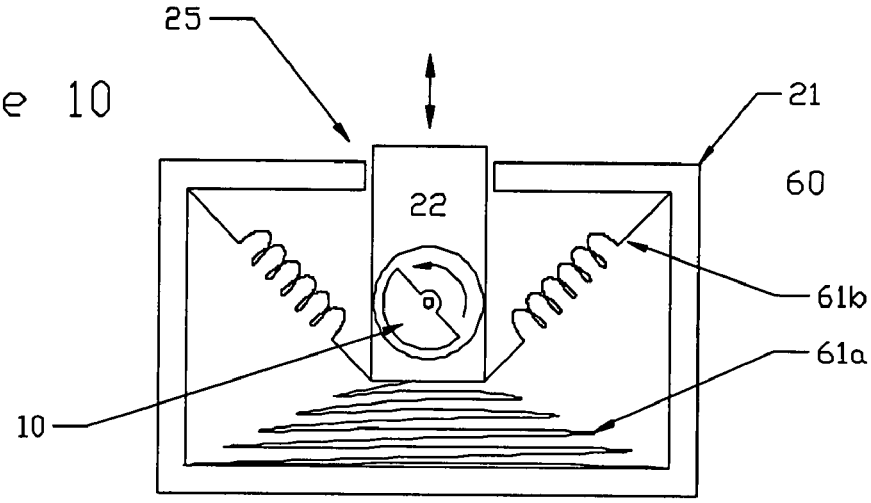
FIG. 10 is a side elevation cross-sectional view of an alternative embodiment of a vibrotactile transducer using a coil spring as the compliant element.

FIG. 10 is a side elevation cross-sectional view of a tapered concentric spring embodiment of a transducer 60. In this embodiment, a tapered spring 61*a* and 61*b* is used as the centering element and used to guide the motor/contactor assembly in the linear motion. The contactor assembly thus vibrates perpendicular to the skin load (not shown). The required transducer spring constant is provided by one or more coil springs 61*a* and 61*b*. A single spring embodiment is also possible where spring 61*b* is omitted, and its compliance is effectively replaced by the compliance of the user's skin when the transducer is held in contact with the body.

Figure 11:
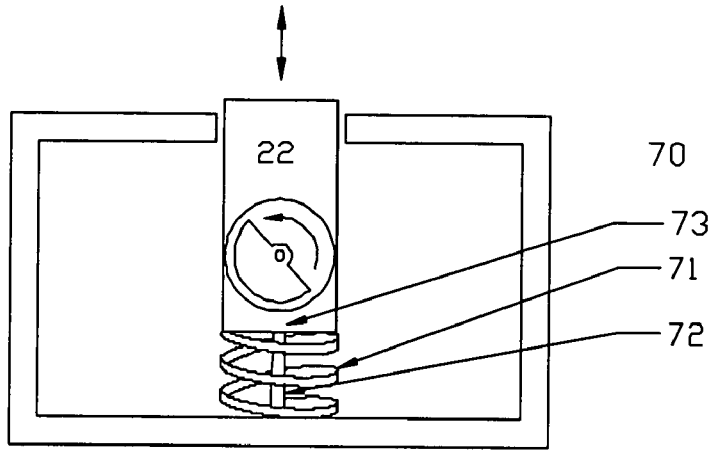
FIG. 11 is a side elevation cross-sectional view of a bearing/coil spring embodiment of a transducer.
Figure 12:
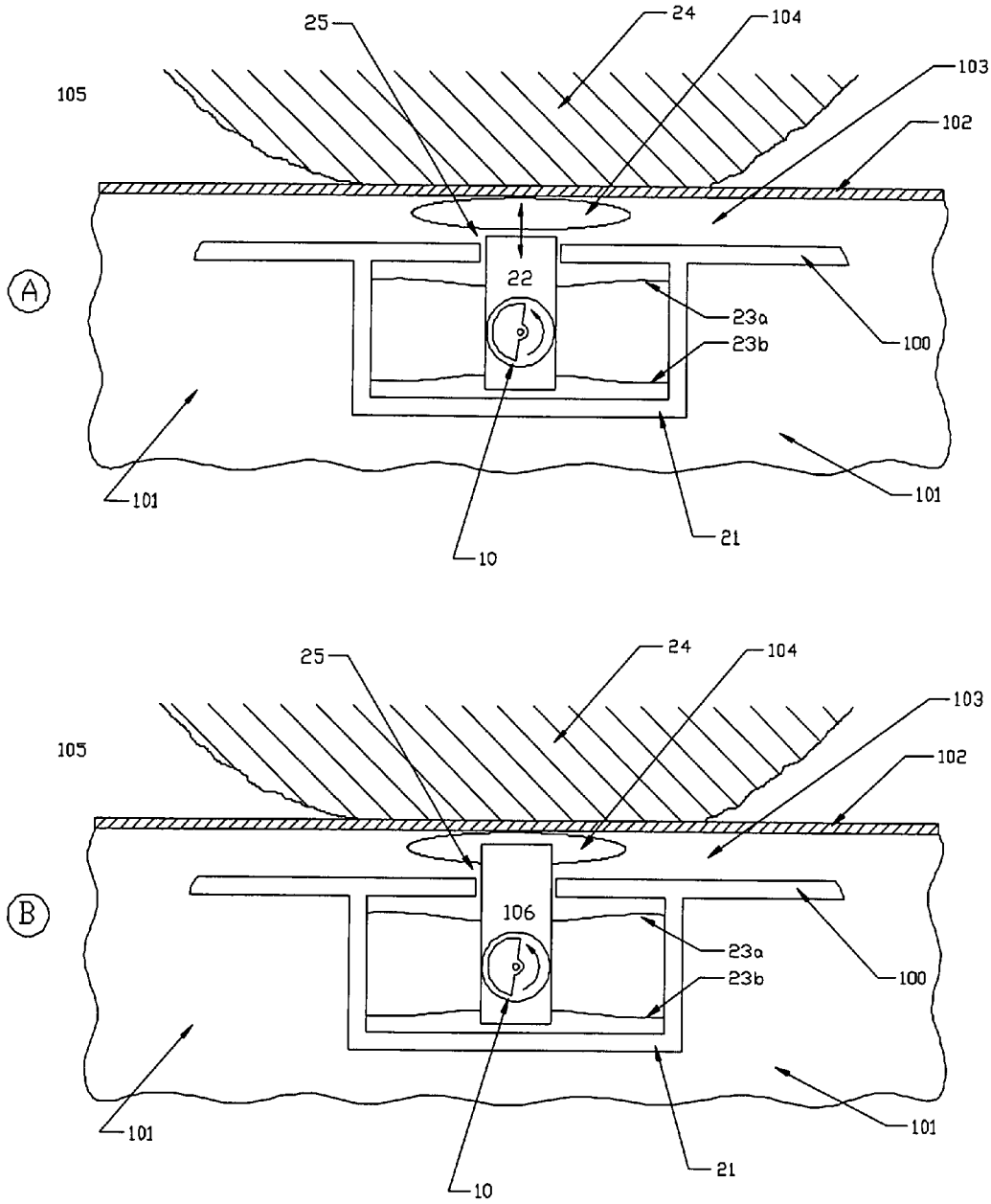
FIGS. 12A-12B are side elevation cross-sectional views of a seat mounted transducer embodiment of this invention.
Figure 13:
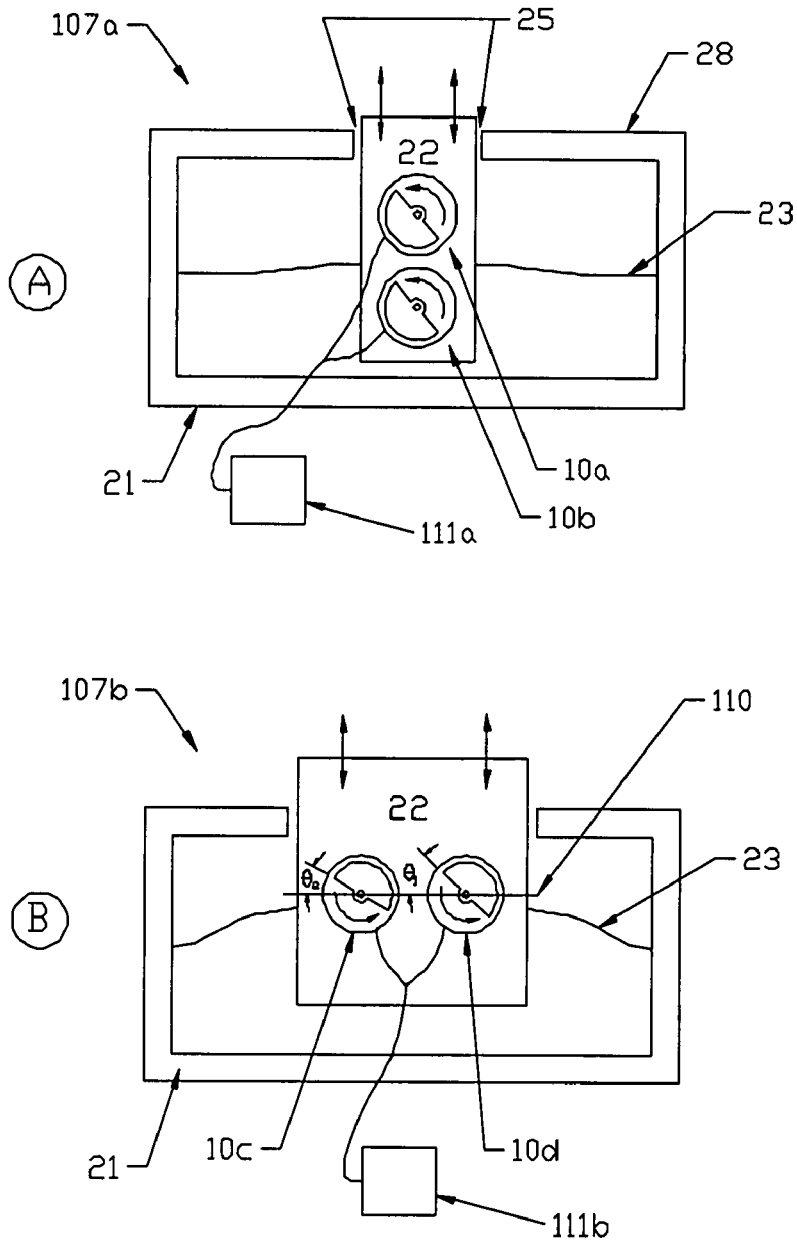
FIGS. 13A-13B are side elevation cross-sectional views of a multiple driver transducer embodiment of this invention.

FIG. 11 is a side elevation cross-sectional view of a bearing/coil spring embodiment of a transducer 70. In this embodiment, a shaft 72 is used as the centering element, and a low friction bearing 73 is used to guide the mechanical contactor assembly 22 in the linear motion. The required spring constant is provided by one or more coil springs 71. Not shown is a similar implementation using planar springs as described in FIG. 7. A single spring embodiment is also possible where spring 41 is omitted, and its compliance is effectively replaced by the compliance of the user's skin when the transducer is held in contact with the body.

FIGS. 12A-12B are side-elevation cross-sectional views of a seat mounted embodiment 105 of this invention. The front surface 100 is designed to "anchor" into the viscous padding foam 101 that is typically used in seats found in motor cars, aircraft and many other vehicles. In this application, the overall transducer weight is not as critical as in wearable transducer designs. The foam material however provides additional damping. This invention provides a predominantly moving contactor that efficiently "concentrates" the displacement over a narrow area 104. This results in more of the EM motor 10 drive force being coupled via the contactor 22 to the intended load 24, which in this case is a skin load adjacent to the padding of the seat material 103 and seat covering 102.

FIG. 12A depicts an embodiment of the invention where the transducer is mounted relatively deeply in the seat foam/padding material.

The selection of EM motor 10, housing contacting face area 100, housing mass, mechanical contactor 22 area, contactor mass and suspension spring compliance 23 again follows the analysis of the free body diagram described in FIG. 5. However, the load impedances $Z_1$ and $Z_2$ will include the additional effect of the seat foam material. The seat foam 101 acts predominantly as a viscous damping load on a large housing area. The contactor 22 area will usually be less than 2 cm diameter, and for thin layers of foam 103 and seat covering 102, the mechanical load impedance will see an increased mass and stiffness contribution from the seat materials (in addition to the skin load).

In some applications, an elongated mechanical contactor 106 can also be extended beyond the housing 21 front face 100 such that the contactor is in close proximity to the skin load 24. This is beneficial in situations where the thickness of the intermediate foam material 104 needs to be minimized to increase the perception of the tactile stimulus. This embodiment of the invention is shown in FIG. 12B.

FIGS. 13A-13B show multiple EM motor actuator embodiments of this invention shown as side-elevation cross-sectional views 107*a* and 107*b*. The overall vibratory response of the actuator can be shaped using two or more EM motor 10*a* and 10*b*, elements that are coupled to a common mechanical contactor 22. In the first embodiment 107*a*, two different sizes of EM motors 10*a* and 10*b* are selected to provide different forcing functions for the actuator. The EM motors can be chosen in terms of their size, rpm and the radius to the center of gravity (COG) of the eccentric mass. The force output from an EM motor is given by:

$$F_{Radial}=M_E r_E \omega^2$$

Where $M_E$ is the eccentric mass, $r_E$ is the radius to the COG of the eccentric mass and $\omega$ is the angular frequency determined by the motor rotation. This well known relationship demonstrates how an EM motor produces an inertial force proportional to the size of the eccentric mass and the rotational velocity squared. It also shows why the force or displacement output is not constant with frequency. Note that the eccentric mass inertial is more difficult to rotate at higher rpm. Larger motors driving a large eccentric mass $M_E$ loads can be used to actuate with a reasonable force at lower angular frequencies while smaller motors driving a relatively small eccentric mass load $M_{E(2)}$ can be used at correspondingly higher frequencies—the combination of the two or more EM motors (and loads that are sized appropriately) can therefore be designed to actuate with approximately constant force across a wide range of operating angular frequencies. A controller 111*a* consists of a means for controlling multiple EM motors, individually or in combination. Said controller may also include a means for measuring the mechanical contactor displacement and using this as a feedback input variable for the controller. The compliance of springs 23, contactor mass (11) and housing mass (21) can be sized in accordance with the load impedance (usually a skin load and skin mechanical impedance) as described hereinbefore and the desired output vibratory characteristics.

In another example 107*b*, the phase rotation $\theta_1$ and $\theta_2$ of similar EM motors 10*c* and 10*d* can be synchronized to obtain a cumulative effect. Both motors are mounted on the same axis 110. The phase of each of the masses is orientated using a motor controller 111*b*. For maximum vertical displacement (i.e. on axis with the contactor), each of the motors should be driven at the same rotational rpm, the eccentric masses simultaneously reaching the vertical axis but the rotational directions being opposite for each motor. This arrangement cancels the lateral displacement of the contactor 22 and produces cumulative vertical vibration. This is desirable as the vibratory output will be perpendicular to an adjacent skin load (not shown) and also provide less lateral forces on the spring component 23.

Accordingly, the invention may be characterized as a vibrotactile transducer to provide a vibrational stimulus to the body of a user in response to an electrical input, including a housing having a contacting face, the contacting face having an opening; a mechanical contactor; suspension means including at least one spring for suspending the mechanical contactor in the housing and constraining the motion of the mechanical contactor in the housing; and at least one eccentric mass motor attached to the mechanical contactor, wherein when an electrical control input is applied to the eccentric mass motor, the inertial forces from the eccentric mass motor causes the mechanical contactor to vibrate between a retracted position within the housing and an extended position through the opening.

The mechanical contactor is preferably separated from the opening by a radial gap, and may have a diameter of between 0.9 cm and 3 cm. The suspension means preferably constrains motion of the mechanical contactor to predominantly perpendicular motion with respect to the contacting face. The suspension means may include at least one leaf spring, at least one spiral spring, or a combination thereof, and may further include a linear bearing. The compliance of the spring is preferably chosen to be resonant with the mass of the housing, the mechanical contactor, and the body mechanical load. The compliance of the spring preferably magnifies the displacement of the mechanical contactor. The at least one eccentric mass motor may include multiple eccentric mass motors attached to the mechanical contactor to produce various effects, which may be synchronized to sequence the combined mechanical contactor and eccentric mass motor motion, or may include at least two differently sized eccentric mass motors, and a controller that preferentially selects the relative usage of the eccentric mass motors, the combinational output offering control of the overall vibrotactile transducer force vs. frequency output of the system. The contacting face may have a mass and area such that it acts as a reciprocating mass in a seat mounted transducer or a wearable transducer.

Alternatively, the invention may be characterized as a method for providing a vibrational stimulus to the body of a user in response to an electrical input, the method comprising the steps of providing a vibrotactile transducer in the form of a housing having a contacting face with an opening, a mechanical contactor, and spring means for suspending the mechanical contactor in the housing so that the mechanical contactor can extend through the opening; attaching at least one eccentric mass motor to the mechanical contactor; pressing the contacting face against the body of a user so that the contacting face and the mechanical contactor are initially in simultaneous contact with the body of the user; and actuating the at least one eccentric mass motor to deliver a vibrational stimulus to the body of the user.

The inventive method may further include the step of suspending the mechanical contactor within the housing to constrain the motion of the mechanical contactor to a plane that is normal to the contacting face, controlling the resonance of the mechanical transducer within the band 50-300 Hz, mounting the vibrotactile transducer within a seat, continuously rotating the at least one eccentric mass motor at low rpm in off periods to avoid start-up delays, or synchronizing multiple eccentric mass motors to sequence the combined mechanical contactor and eccentric mass motor motion.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. Therefore, the above description and illustrations should not be construed as limiting the scope of the invention, which is defined by the appended claims.

What is claimed as invention is:

1. A vibrotactile transducer to provide a vibrational stimulus to the body of a user in response to an electrical input, said vibrotactile transducer comprising;

a housing having a contacting face, said contacting face having an opening;

a mechanical contactor rigidly connected to at least one eccentric mass motor, said eccentric mass motor having an axis of rotation; and suspension means including at least one spring for suspending said mechanical contactor and said at least one eccentric mass motor in said housing and constraining the motion of said mechanical contactor in said housing to a linear motion substantially perpendicular to said eccentric mass motor axis of rotation; wherein when said mechanical contactor is positioned against the body of a user, said mechanical contactor is retracted with respect to said housing to preload said mechanical contactor against the action of said at least one spring, and when an electrical control input is applied to said at least one eccentric mass motor, the inertial forces from said at least one eccentric mass motor causes said mechanical contactor to vibrate between a retracted position and an extended position through said opening.

2. The vibrotactile transducer of claim 1 wherein said mechanical contactor is separated from said opening by a radial gap.

3. The vibrotactile transducer of claim 1 wherein said mechanical contactor has a diameter of between 0.9 cm and 3 cm.

4. The vibrotactile transducer of claim 1 wherein said suspension means constrains motion of said mechanical contactor to predominantly perpendicular motion with respect to said contacting face.

5. The vibrotactile transducer of claim 1 wherein said suspension means comprises at least one leaf spring.

6. The vibrotactile transducer of claim 1 wherein said suspension means comprises at least one spiral spring.

7. The vibrotactile transducer of claim 1 wherein said suspension means comprises a combination of the at least one spring and a linear bearing.

8. The vibrational transducer of claim 1 wherein the compliance of said at least one spring is chosen to be resonant with the mass of said housing, said mechanical contactor and said at least one eccentric mass motor, and the body mechanical load.

9. The transducer of claim 1 wherein the compliance of said at least one spring magnifies the displacement of said mechanical contactor.

10. The vibrotactile transducer of claim 1 wherein said at least one eccentric mass motor comprises multiple eccentric mass motors rigidly connected to said mechanical contactor to produce various effects.

11. The vibrotactile transducer of claim 10 wherein said multiple eccentric mass motors are synchronized to sequence the combined mechanical contactor and eccentric mass motor motion.

12. The vibrotactile transducer of claim 10 wherein said multiple eccentric mass motors comprise at least two differently sized eccentric mass motors, and a controller that selects the relative usage of said eccentric mass motors, the combinational output offering control of the overall vibrotactile transducer force vs. frequency output of the system.

13. The vibrotactile transducer of claim 1 wherein said contacting face has a mass and area such that it acts as a reciprocating mass in a seat mounted transducer.

14. The vibrotactile transducer of claim 1 wherein said contacting face has a mass and area such that it acts as a reciprocating mass in a wearable transducer.

15. A method for providing a vibrational stimulus to the body of a user in response to an electrical input, said method comprising the steps of:

providing a vibrotactile transducer in the form of a housing having a contacting face with an opening, a mechanical contactor rigidly coupled to at least one eccentric mass motor, the motor having an axis of rotation, and spring means for suspending the mechanical contactor and the at least one eccentric mass motor in the housing so that the mechanical contactor can extend through the opening and is constrained to a linear motion substantially perpendicular to the motor axis of rotation;

pressing the contacting face against the body of a user so that the contacting face and the mechanical contactor are initially in simultaneous contact with the body of the user and the mechanical contactor is retracted with respect to the housing to preload the mechanical contactor against the action of the spring means; and actuating the at least one eccentric mass motor to deliver a vibrational stimulus to the body of the user.

16. The method for providing a vibrational stimulus to the body of a user of claim 15 including the step of suspending the mechanical contactor within the housing to constrain the motion of the mechanical contactor to a plane that is normal to the contacting face.

17. The method for providing a vibrational stimulus to the body of a user of claim 15 further including the step of controlling the resonance of the vibrotactile transducer within the band 50-300 Hz.

18. The method for providing a vibrational stimulus to the body of a user of claim 15 further including the step of continuously rotating the at least one eccentric mass motor at low rpm to avoid start-up delays.

19. The method for providing a vibrational stimulus to the body of a user of claim 15 further including the step of synchronizing multiple eccentric mass motors to sequence the combined mechanical contactor and eccentric mass motor motion.

20. A method for providing a vibrational stimulus to the body of a user seated in a seat in response to an electrical input, said method comprising the steps of:

providing a vibrotactile transducer in the form of a housing having a front surface with an opening, a mechanical contactor rigidly coupled to at least one eccentric mass motor, the motor having an axis of rotation, and spring means for suspending the mechanical contactor and the at least one eccentric mass motor in the housing so that the mechanical contactor can extend through the opening and is constrained to a linear motion substantially perpendicular to the motor axis of rotation;

mounting the vibrotactile transducer in the seat so that the front surface is anchored in the seat material and the mechanical contactor is oriented toward the body of the user such that when the user is seated in the seat, the mechanical contactor is retracted with respect to the housing to preload the mechanical contactor against the action of the spring means; and actuating the at least one eccentric mass motor to deliver a vibrational stimulus through the seat material and to the body of the user.

* * * * *